US007499016B2

(12) United States Patent
Oh et al.

(10) Patent No.: US 7,499,016 B2
(45) Date of Patent: Mar. 3, 2009

(54) LIQUID CRYSTAL DISPLAY DEVICE

(75) Inventors: Eun-Jung Oh, Suwon-si (KR); Tae-Soo Kim, Suwon-si (KR)

(73) Assignee: Samsung Mobile Display Co., Ltd., Suwon-si (KR)

( * ) Notice: Subject to any disclaimer, the term of this patent is extended or adjusted under 35 U.S.C. 154(b) by 632 days.

(21) Appl. No.: 11/133,857

(22) Filed: May 19, 2005

(65) Prior Publication Data

US 2006/0007099 A1 Jan. 12, 2006

(30) Foreign Application Priority Data

Jun. 3, 2004 (KR) ..... 10-2004-0040295

(51) Int. Cl.
*G09G 3/36* (2006.01)

(52) U.S. Cl. ..... 345/102; 345/87; 345/89; 345/204; 345/211; 345/212; 345/690

(58) Field of Classification Search ..... 345/87, 345/89, 102, 211–213, 690–693, 204
See application file for complete search history.

(56) References Cited

U.S. PATENT DOCUMENTS

| | | | | |
|---|---|---|---|---|
| 6,510,995 | B2 * | 1/2003 | Muthu et al. | 235/454 |
| 6,630,801 | B2 * | 10/2003 | Schuurmans | 315/307 |
| 7,315,139 | B1 * | 1/2008 | Selvan et al. | 312/291 |
| 2002/0135553 | A1 | 9/2002 | Nagai et al. | |
| 2006/0187181 | A1 * | 8/2006 | Kim | 345/102 |

FOREIGN PATENT DOCUMENTS

| | | |
|---|---|---|
| JP | 10-39301 | 2/1998 |
| KR | 2000-231363 | 8/2000 |
| KR | 2001-0051594 | 6/2001 |
| KR | 2002-0010653 | 2/2002 |

OTHER PUBLICATIONS

Patent Abstracts of Japan for Publication No. 2000-231363, Date of publication of application Aug. 22, 2000, in the name of Masatoshi Oishi et al.
Korean Patent Abstracts for Publication No. 1020010051594; Date of publication of application Jun. 25, 2001, in the name of Koichi Kaga et al.
Patent Abstracts of Japan, Publication No. 10-039301; Date of Publication: Feb. 13, 1998; in the name of Koichi Fukazawa.

* cited by examiner

*Primary Examiner*—My-Chau T Tran
*Assistant Examiner*—Jennifer T Nguyen
(74) *Attorney, Agent, or Firm*—Christie, Parker & Hale, LLP

(57) ABSTRACT

A liquid crystal display device including a light source controller for controlling red, green, and blue lights to be sequentially transmitted through a liquid crystal and a pixel formed between a first substrate on which a first electrode is formed and a second substrate on which a second electrode is formed. A first red light emitting diode (LED) has a first terminal coupled to a first terminal of the light source controller; and a second red LED has a first terminal coupled to a second terminal of the first red LED. A green LED has a first terminal coupled to the first terminal of the light source controller; and a blue LED has a first terminal coupled to the first terminal of the light source controller.

18 Claims, 6 Drawing Sheets

LIQUID CRYSTAL DISPLAY DEVICE

CROSS REFERENCE TO RELATED APPLICATION

This application claims priority to and the benefit of Korean Patent Application No. 10-2004-0040295 filed on Jun. 3, 2004 in the Korean Intellectual Property Office, the entire content of which is incorporated herein by reference.

BACKGROUND OF THE INVENTION

1. Field of the Invention

The present invention relates to a liquid crystal display device, and more particularly, to a field sequential driving method and a liquid crystal display device using the same.

2. Description of the Related Art

Recently, personal computers and televisions have become lightweight and flat, and accordingly display devices are being required to be more light weighted and thinner. Thus, for use instead of a cathode ray tube (CRT), flat panel displays including a liquid crystal display (LCD) have been developed.

An LCD device utilizes two substrates and a liquid crystal material having an anisotropic dielectric constant injected therebetween, in which an electric field is applied to the liquid crystal material. The amount of light from an external light source transmitted through the substrates is controlled by intensity of the electric field to obtain a desired image signal.

Such an LCD is the most common type of the flat panel displays, and especially, a thin film transistor (TFT)-LCD using a TFT as a switching element is most commonly used.

Each pixel in the TFT-LCD can be modeled using a capacitor having a liquid crystal as a dielectric material, that is a liquid crystal capacitor. An equivalent circuit diagram of such a pixel is shown in FIG. 1.

As shown in FIG. 1, each pixel in an LCD device includes a TFT 10 having a source electrode and a gate electrode respectively coupled to a data line Dm and a scan line Sn, a liquid capacitor Cl coupled between a drain electrode of the TFT 10 and a common voltage source Vcom, and a storage capacitor Cst coupled to the drain electrode of the TFT 10.

As can be seen in FIG. 1, the TFT 10 is turned on when a scan signal is applied to the scan line, and a data voltage Vd supplied to the data line Dm is applied to each pixel (not shown) through the TFT 10. Then, an electric field corresponding to a difference between a pixel voltage Vp and the common voltage Vcom is applied to a liquid crystal (equivalently shown as a liquid crystal capacitor Cl in FIG. 1), and light transmittance is determined by intensity of the electric field. Here, the pixel voltage Vp is maintained for one frame scan or one field, and the storage capacitor Cst is auxiliarily used to maintain the pixel voltage Vp applied to the pixel electrode.

In general, methods of displaying a color image on an LCD device can be classified into a color filter method and a field sequential driving method.

An LCD device employing the color filter method forms a color filter layer having 3 primary colors (red, green, and blue) on one of substrates, and controls the amount light transmitted to the color filter to express a desired color. An LCD employing the color filter method adjusts the amount of light from a single light source transmitted through red, green, and blue color filters, and combines the red, green, and blue lights to display a desired color.

Such an LCD device displaying colors using a single-light source and three color filter layer requires three times or more pixels, compared to displaying monochrome, to respectively correspond to red, green, and blue color areas. Accordingly, a sophisticated manufacturing technology is required to obtain a high resolution image.

Moreover, adding a separate color filter layer on the substrate of the LCD causes the manufacturing of the LCD to be complicated, and light transmittance of the color filter must be considered as well.

On the other hand, an LCD employing the field sequential driving method periodically and sequentially turns on/off independent red, green, and blue signals, and synchronously applies a corresponding color signal to the pixel in accordance with the turn on/off period to thereby obtain a full-colored image. In other words, the field sequential driving method uses persistence of vision to display a colored image by way of outputting the red, green, and blue (RGB) lights from RGB light sources (i.e., backlights) and time-dividing the red, green, and blue lights, and sequentially displaying the time-divided red, green, and blue lights on a pixel instead of dividing the pixel into three pixels for red, green, and blue colors.

The field sequential driving method can be classified into an analog driving method or a digital driving method.

The analog driving method predetermines a plurality of gradation voltages corresponding to a total number of gradations to be displayed, and selects a gradation voltage corresponding to gradation data from the plurality of gradation voltages to drive a liquid crystal panel to thereby express gradation using the amount of light transmitted corresponding to the gradation voltage applied to the liquid crystal panel.

FIG. 2 illustrates a driving voltage and the amount of transmitted light of an LCD panel employing a conventional analog driving method. As shown therein, the driving voltage represents a voltage applied to the liquid crystal, and the optical transmittance represents a ratio of the amount of light transmitted through the liquid crystal to the amount of incident light. In other words, the optical transmittance represents the degree of distortion of the liquid crystal so that the light can pass therethrough.

Referring to FIG. 2, a driving voltage at V11 level is applied to the liquid crystal in an R-field period Tr for displaying a red color and the amount of light transmitted through the liquid crystal corresponds to the driving voltage. In a G-field period Tg for displaying a green color, a driving voltage at V12-level is applied and a corresponding amount of light is transmitted through the liquid crystal. Further, in a B-field period Tb for displaying a blue color, a driving voltage at V13 level is applied and a corresponding amount of light is transmitted through the liquid crystal. By adding the red, green, and blue lights respectively transmitted through the Tr, Tg, and Tb, a desired colored image can be displayed.

On the other hand, the digital driving method regulates driving voltages applied to the liquid crystal and controls a voltage application time to thereby express gradations (i.e., grayscales). According to the digital driving method, the gradations are expressed by maintaining the regulated driving voltage and adjusting a timing or duration of the voltage application to control an accumulated amount of light transmitted through the liquid crystal.

FIG. 3 illustrates waveforms that explain a driving method of an LCD device employing a conventional digital driving method. Waveforms of a driving voltage in accordance with a predetermined number of bits of driving data and corresponding optical transmittance of a liquid crystal are illustrated.

As shown in FIG. 3, a 7-bit digital signal is provided as gradation waveform data for each gradation, and a corresponding gradation waveform is applied to the liquid crystal.

The optical transmittance of the liquid crystal is determined according to the applied gradation waveform, thereby expressing the gradations.

The LCD device employing the conventional field sequential method uses a light emitting diode (LED) as the backlight of R, G, and B, and sequentially drives a red LED, a green LED, and a blue LED. In other words, the field sequential method has an R-field period for red color, a G-field period for green color, and a B-field period for blue color, and the red, green, and blue LEDs are sequentially turned on to emit red, green, and blue lights. Each of red, green, and blue data is applied to the liquid crystal and accumulated in the respective field periods, and a colored image can be displayed through the accumulated red, green, and blue lights.

FIG. 4 shows a relationship between each of conventional LEDs that respectively emit red, green, and blue lights, and a light source controller driving the conventional LEDs.

As shown in FIG. 4, the conventional LEDs include a red LED (RLED), a green LED (GLED), and a blue LED (BLED), and these LEDs are coupled to the light source controller. When gradation data is applied to a pixel, the light source controller immediately turns on the RLED, GLED, and BLED in sequence, and applies a forward voltage Vf to the respective LEDs to thereby emit light providing sufficient luminance. In FIG. 3, anodes of the RLED, GLED, and BLED are coupled to a common terminal VLED supplying the forward voltage, and cathodes of the RLED, GLED, and BLED are respectively coupled to selection terminals R_OUT, G_OUT, and B_OUT. Here, each of the selection terminals R_OUT, G_OUT, and B_OUT is sequentially turned on, and at the same time, the forward voltage is sequentially applied to the RLED, GLED, and BLED to thereby turn them on.

Here, each of the LEDs, namely, RLED, GLED, and BLED, requires different voltage level to be turned on, and different forward voltages Vf result in different forward currents If. Further, the amount of luminance of the red LED RLED, green LED GLED, and blue LED BLED are respectively different according to the forward current If. Here, the forward voltage Vf represents a voltage applied to the LEDs after the LEDs are turned on, and the forward current If represents a current flowing to the LEDs when the forward voltage Vf is applied thereto.

FIGS. 5A and 5B illustrate a relationship between a forward voltage Vf and a forward current If in typical red, green, and blue LEDs, and relative luminance corresponding thereof. FIG. 5A shows a relationship between the forward voltage and a corresponding forward current, and FIG. 5B shows the forward current and corresponding relative luminance or luminance.

As shown in FIG. 5B, relative luminance of the red, green, and blue LEDs are substantially the same when the forward current If applied thereto is set to be 20 mA. For white balancing, the green LED and the blue LED respectively require 3.4V and 3.25V of forward voltages but the red LED requires only 2.1V of forward voltage which is relatively lower than the forward voltages of the green and blue LEDs. The forward voltage is supplied from a terminal VLED of the light source controller, and the light source controller respectively applies associated forward voltages to the red, green, and blue LEDs in sequence. Here, the forward voltage 3.4V of the green LED and the forward voltage 3.25V of the blue LED have a similar voltage value, but the forward voltage 2.1V of the red LED is comparatively lower than the forward voltages of the green and blue LEDs, thereby generating a voltage ripple in the light source controller. In other words, variation of forward voltages produces the voltage ripple, thereby resulting in many problems in controlling the amount of light emitted from the respective LEDs.

SUMMARY OF THE INVENTION

Accordingly, in exemplary embodiments of the present invention, an LCD device that supplies almost the same or similar forward voltages applied to each of LEDs, is provided to thereby solve the forgoing problems.

In addition, the LCD device according to the exemplary embodiments of the present invention may be designed to consume less power.

To achieve the foregoing and/or other aspects of the present invention, in an exemplary embodiment of the present invention, an LCD device including a pixel formed by a liquid crystal disposed between a first substrate on which a first electrode is formed and a second substrate on which a second electrode is formed, and a light source controller having a first terminal, is provided. The light source controller controls red, green, and blue lights to be sequentially transmitted through the pixel. The LCD device also includes first and second red LEDs, a first green LED, and a blue LED. The first red LED has a first terminal and a second terminal, the first terminal being coupled to the first terminal of the light source controller. The second red LED has a first terminal coupled to the second terminal of the first red LED. The first green LED has a first terminal coupled to the first terminal of the light source controller. The blue LED has a first terminal coupled to the first terminal of the light source controller.

The LCD device may further include a second green LED having a first terminal coupled to the first terminal of the light source controller, and coupled to the first green LED in parallel.

A first voltage applied by the light source controller to emit the first and second red LEDs, a second voltage applied by the light source controller to emit the first and second green LEDs, and a third voltage applied by the light source controller to emit the blue LED may have almost the same or similar voltage levels.

A combined luminance of the first and second red LEDs, a combined luminance of the first and second green LEDs, and luminance of the blue LED may substantially correspond to each other.

In another exemplary embodiment according to the present invention, an LCD device including a pixel formed by a liquid crystal disposed between a first substrate on which a first electrode is formed and a second substrate on which a second electrode is formed, and a light source controller having first, second, third and fourth terminals, is provided. The light source controller controls red, green, and blue lights to be sequentially transmitted through the pixel. The LCD device also includes a pair of red LEDs, a green LED and a blue LED. The pair of red LEDs are coupled in series between the first terminal and the second terminal of the light source controller. The green LED is coupled between the first terminal and the third terminal of the light source controller. The blue LED is coupled between the first terminal and the fourth terminal of the light source controller.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
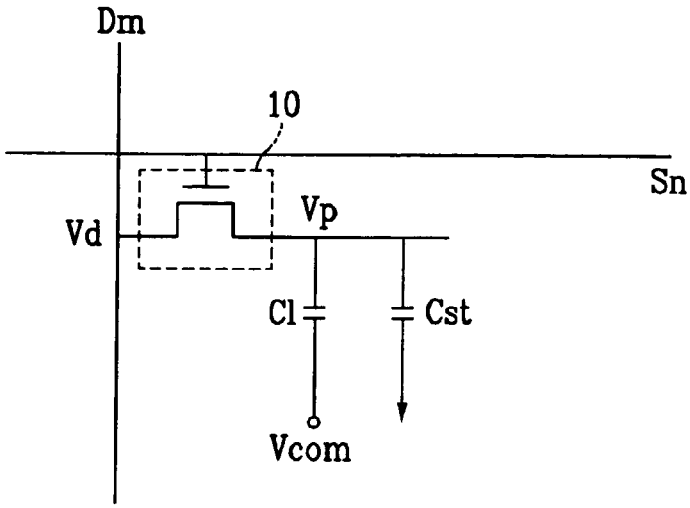
FIG. 1 (Prior Art)
FIG. 1 shows a pixel in a conventional TFT-LCD.
Figure 2:
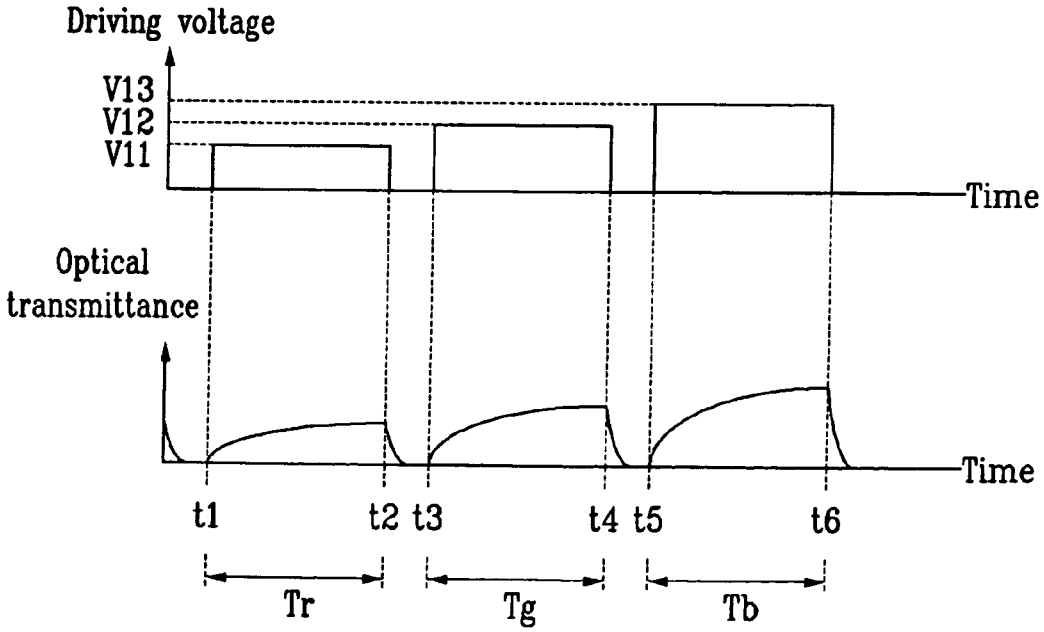
FIG. 2 (Prior Art)
FIG. 2 is a waveform illustrating a driving method of an LCD device employing a conventional analog method.
Figure 3:
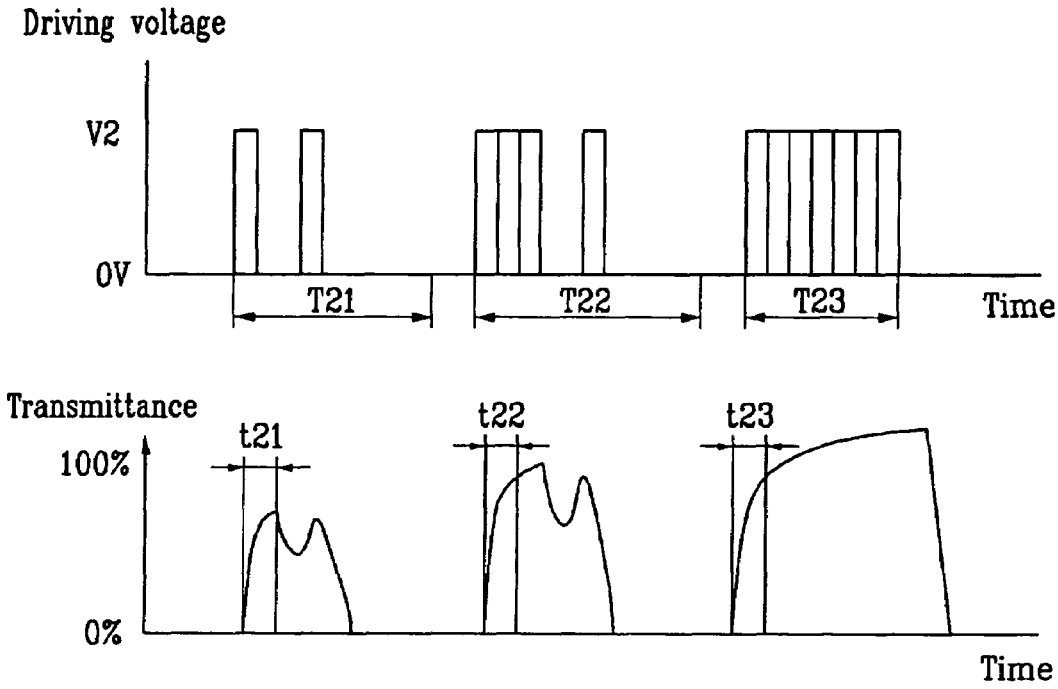
FIG. 3(Prior Art)
FIG. 3 is a waveform illustrating a driving method of an LCD device employing a conventional digital method.

In the following detailed description, only certain exemplary embodiments of the present invention are shown and described, simply by way of illustration. As those skilled in the art would realize, the described embodiments may be modified in various different ways, all without departing from the spirit or scope of the present invention. Accordingly, the drawings and description are to be regarded as illustrative in nature, and not restrictive. There may be parts shown in the drawings, or parts not shown in the drawings, that are not discussed in the specification as they are not essential to a complete understanding of the invention. Like reference numerals designate like elements.

Hereinafter, an LCD device according to exemplary embodiments of the present invention will be described with reference to FIG. 6 to FIG. 9. The LCD device according to the exemplary embodiments of the present invention has a sufficient number of LEDs for emitting red, green, and blue lights, that have a suitable relationship with each other, and with other components of the LCD device.

Figure 6:
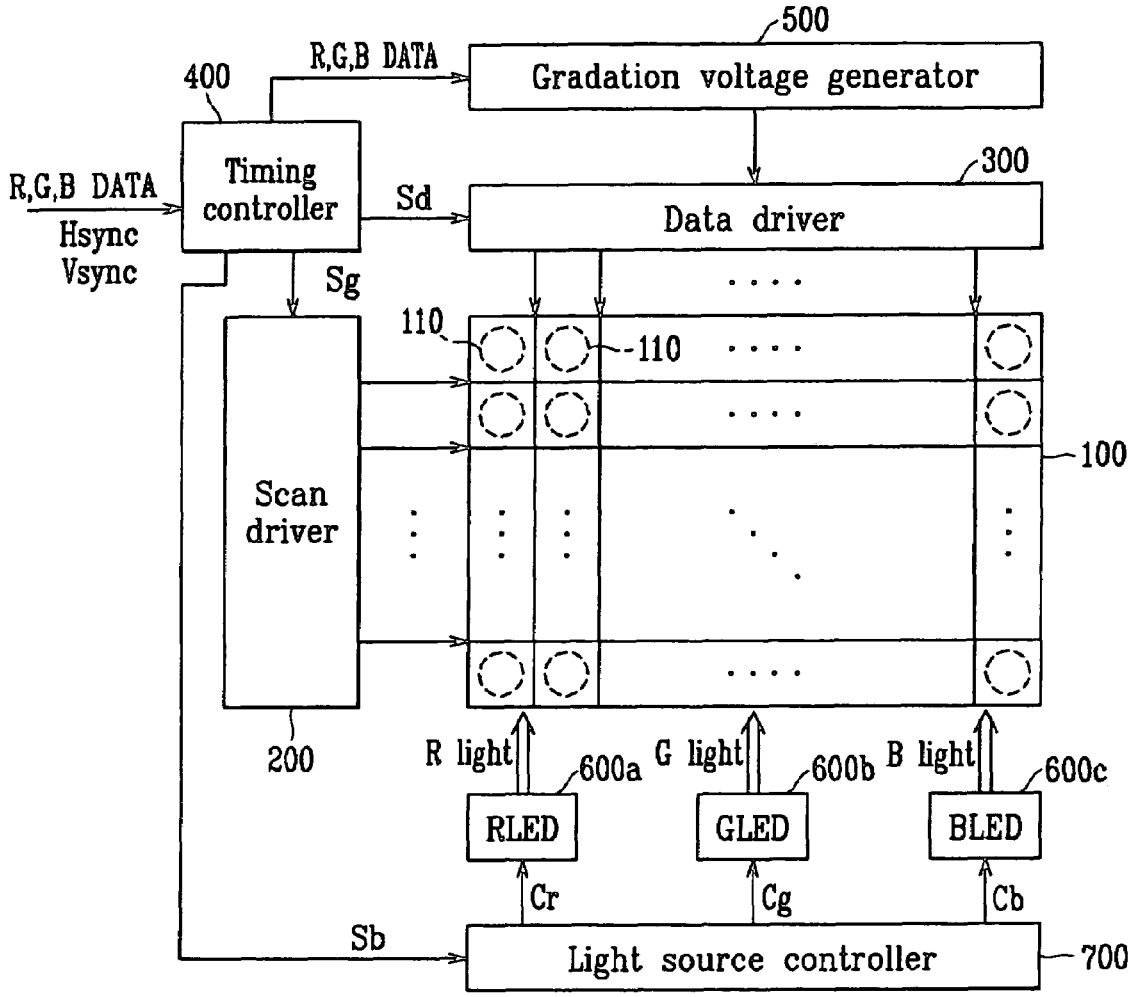
FIG. 6 illustrates an LCD device according to exemplary embodiments of the present invention.

As shown in FIG. 6, the LCD device according to the exemplary embodiments of the present invention includes an LCD panel 100, a scan driver 200, a data driver 300, a gradation voltage generator 500, a timing controller 400, LEDs RLED 600*a*, GLED 600*b*, and BLED 600*c* respectively emitting red, green, and blue lights, and a light source controller 700.

The LCD panel 100 has a plurality of scan lines for transmitting gate-on signals, and a plurality of data lines dielectrically crossing the plurality of scan lines and for transmitting a gradation data voltage and a reset voltage. A plurality of pixels 110 arranged in a matrix format are surrounded by the scan lines and the data lines. Each pixel includes a thin film transistor TFT (not shown) having a gate electrode and a source electrode respectively coupled to the scan line and the data line, a pixel capacitor (not shown) coupled to a drain electrode of the TFT, and a storage capacitor (not shown).

The scan driver 200 sequentially applies scan signals to the scan lines and turns on the TFT having the gate electrode coupled to the scan line to which the scan signal is applied.

The timing controller 400 receives the gradation data signal RGB DATA, a horizontal synchronization (Hsync) signal, and a vertical synchronization (Vsync) signal from an external device or a graphic controller (not shown), and provides necessary control signals Sg, Sd, and Sb to the scan driver 200, the data driver 300, and the light source controller 700, respectively, and provides the gradation data signal RGB DATA to the gradation voltage generator 500.

The gradation voltage generator 500 generates a gradation voltage corresponding to the gradation data and supplies the gradation voltage to the data driver 300. The data driver 300 applies the gradation voltage outputted from the gradation voltage generator 500 to a corresponding data line.

The LEDs 600*a*, 600*b*, and 600*c* respectively output red, green, and blue lights, and the light source controller 700 controls turn-on timing of the LEDs 600*a*, 600*b*, and 600*c* using control signals Cr, Cg and Cb, respectively. The LEDs 600*a*, 600*b*, and 600*c* according to the exemplary embodiments of the present invention are configured to substantially prevent voltage ripple generated due to a difference between forward voltages Vf respectively applied to the LEDs 600*a*, 600*b*, and 600*c*. Further, LEDs 600*a*, 600*b*, and 600*c* according to one of the exemplary embodiments of the present invention are configured to consume less power.

In the LCD device of FIG. 6, the timing for the data driver 300 for applying an associated gradation voltage to the data line and the timing for the light source controller 700 to turn on the LEDs RLED, GLED, and BLED can be synchronized by a control signal provided from the timing controller 400.

Figure 7:
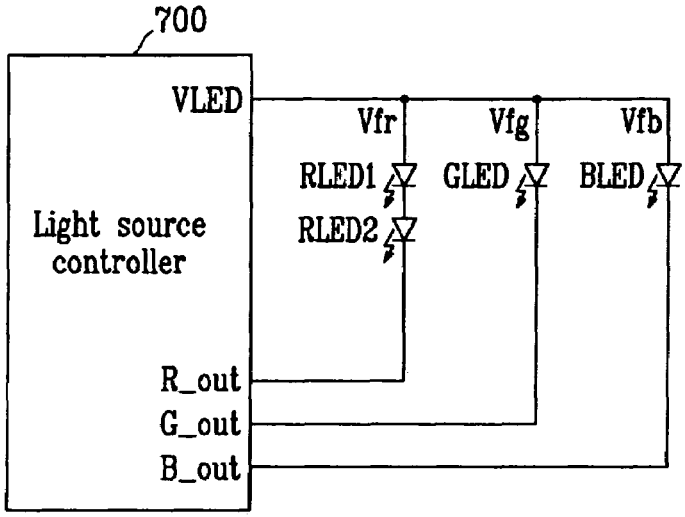
FIG. 7 shows a configuration of LEDs coupled to a light source controller according to a first exemplary embodiment of the present invention.
Figure 8:
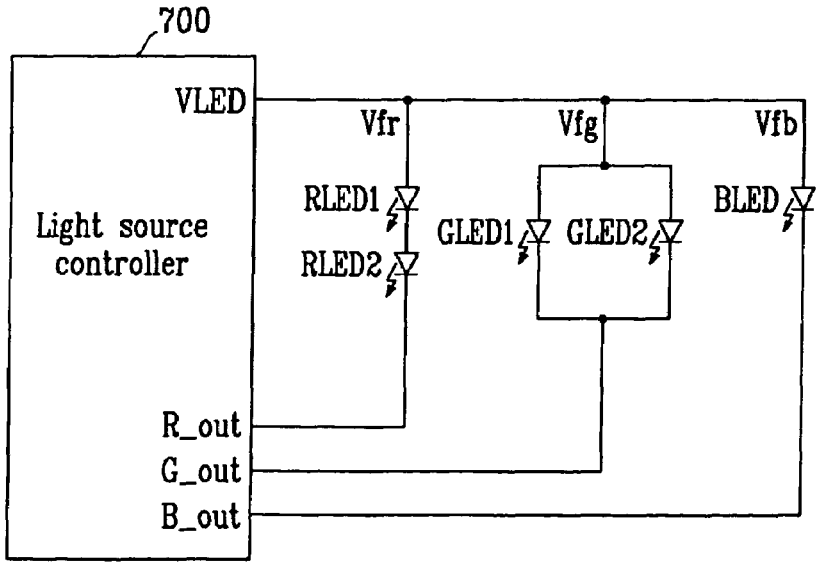
FIG. 8 shows a configuration of LEDs coupled to a light source controller according to a second exemplary embodiment of the present invention.

FIG. 7 illustrates a configuration of the LEDs coupled to the light source controller 700 according to a first exemplary embodiment of the present invention. In the configuration of the LEDs according to the first exemplary embodiment of the present invention, two red LEDs, namely, RLED1 and RLED2, are coupled in series to reduce a difference between forward voltages applied to the respective LEDs, thereby substantially preventing the voltage ripple. The light source controller 700 of FIGS. 7 and 8 is substantially the same as the light source controller 700 of FIG. 6.

As shown in FIG. 7, the configuration of the LEDs according to the first exemplary embodiment of the present invention includes two red LEDs, RLED1 and RLED2, coupled in series, a green LED GLED, a blue LED BLED, and the light source controller 700. The red LEDs, the green LED, and the blue LED are coupled to the light source controller 700. All of the LEDs in FIG. 7 can be embedded in a single integral circuit (IC) chip or a plurality of IC chips. The single IC chip and/or one or more of the plurality of IC chips may have substantially the same configuration as shown in FIG. 7. Further, the RLED1 and RLED2 coupled in series can be used as the RLED 600*a* of FIG. 6, while the GLED and BLED can be respectively used as the GLED 600*b* and the BLED 600*c* of FIG. 6.

Referring back to FIGS. 5A and 5B, luminance using two red LEDs according to the first exemplary embodiment of the present invention and luminance using one red LED according to the conventional method should be substantially the same for white balancing purposes. In other words, the luminance of the two red LEDs RLED1 and RLED2 coupled in series can be made substantially the same as the luminance of one LED through reducing the luminance of the two red LEDs RLED1 and RLED2 by substantially one-half (50%).

Figure 5A:
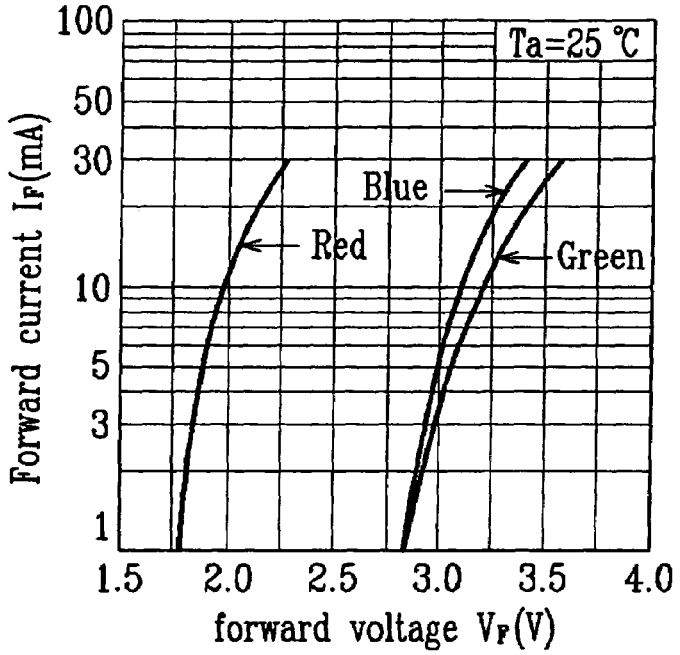
FIGS. 5A and 5B show a relationship between a forward voltage and a forward current, and a corresponding relative luminance in typical red, green, and blue LEDs.
Figure 5B:
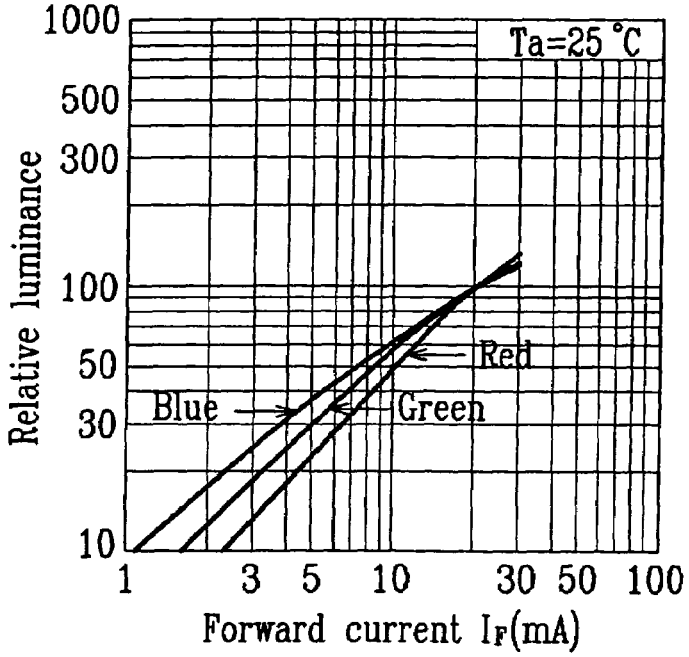

In consideration of the luminance problem, 10 mA of forward current can be applied to the red LEDs RLED1 and RLED2 coupled in series to reduce relative luminance from 100 to 50, as can be seen in FIG. 5B. Accordingly, relative luminances of each of the red LEDs RLED1 and RLED2 become 50 in the case of respectively applying 10 mA of forward current to the two red LEDs RLED1 and RLED2 coupled in series. Thus, a total relative luminance of the two red LEDs RLED1 and RLED 2 becomes 100. Here, 10 mA of forward current can be respectively applied to the two red LEDs RLED1 and RLED2 by respectively applying 1.9V of forward voltage to the red LEDs RLED1 and RLED2, as can be seen in FIG. 5A. Therefore, 3.8V (1.9V×2=3.8V) of forward voltage is required to respectively apply 10 mA of forward current to the two red LEDs RLED1 and RLED2 coupled in series to control the relative luminances of each of the red LEDs RLED1 and RLED2 to be 50.

Accordingly, a forward voltage Vfr outputted from the terminal VLED of the light source controller 700 becomes 3.8V when the red LEDs RLED1 and RLED2 are coupled in series. Sequentially, forward voltages Vfg and Vfb respectively outputted for the green and blue LEDs GLED and BLED are 3.4V and 3.25V, respectively, and thus the forward voltages outputted from the light source controller 700 for the respective LEDs become almost the same or similar to each other, thereby substantially preventing the occurrence of the voltage ripple. This way, the relative luminances of the red, green, and blue LEDs become 100, and does not cause any white balance problem.

Further, the forward voltages applied to the green LED GLED and the blue LED BLED are respectively 3.4V (Vfg) and 3.25 (Vfb) which are the same values as conventional, and thus the forward currents flowing therefrom are 20 mA, respectively.

A total power consumed by each of the LEDs in the above configuration according to the first exemplary embodiment of the present invention is given as Equations 1-3. First, a total power consumption of the red LEDs RLED1 and RLED2 are given as Equation 1.

$$P=V\times I=3.8V\times 10\ mA=38\ mW \quad \text{[Equation 1]}$$

where a combined forward voltage Vfr of the red LEDs RLED1 and RLED2 is set to be 3.8V, and the forward current flowing therethrough is set to be 10 mA.

A total power consumption of the green LED GLED is given as Equation 2.

$$P=V\times I=3.4V*20\ mA=68\ mW \quad \text{[Equation 2]}$$

where the forward voltage Vfg applied to the green LED GLED is set to be 3.4V and the forward current flowing therethrough is set to be 20 mA.

Further, a total power consumption of the blue LED BLED is given as Equation 3.

$$P=V\times I=3.5\ V\times 20\ mA=65\ mW \quad \text{[Equation 3]}$$

where the forward voltage Vfb applied to the blue LED BLED is set to be 3.25V and the forward current flowing therethrough is set to be 20 mA.

As shown in Equations 1, 2, and 3, the green LED GLED consumes the most power. Hereinafter, a method for reducing the power consumption of the green LED GLED will be described.

FIG. 8 shows a configuration of the LEDs according to a second exemplary embodiment of the present invention. The configuration of the LEDs according to the second exemplary embodiment of the present invention is designed to reduce power consumption of the green LED GLED.

According to the configuration shown in FIG. 8, two green LEDs GLED1 and GLED2 are coupled in parallel. A red LED RLED and a blue LED BLED are designed as they were in the first exemplary embodiment of the present invention, and therefore detailed descriptions related thereto will be omitted. The red LEDs RLED1 and RLED2 coupled in series can be used as the RLED 600*a* of FIG. 6, while the green LEDs GLED1 and GLED2 coupled in parallel can be used as the GLED 600*b* of FIG. 6. Further, the blue LED 600*c* can be used as the BLED 600*c* of FIG. 6.

Figure 4:
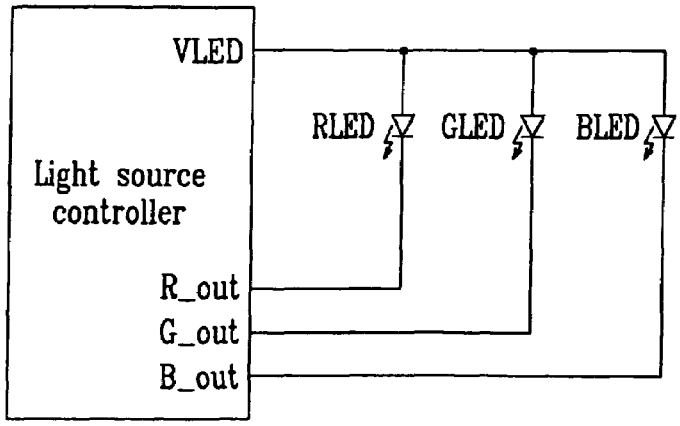
FIG. 4(Prior Art)
FIG. 4 shows a relationship between LEDs respectively emitting red, green, and blue lights and a light source controller for driving the LEDs.

The two green LEDs GLED1 and GLED2 coupled in parallel should have the same luminance as one green LED GLED of FIG. 4, for example, to realize white balance. Accordingly, each of the green LEDs GLED1 and GLED2 should have one-half the luminance (50%) of the luminance of one green LED GLED. As shown in FIG. 5B, 8 mA of forward current If must be applied to reduce the relative luminance of the green LEDs GLED1 and GLED2 from 100 to 50. Thus, 3.15V of forward voltage Vf must be applied to the green LEDs GLED1 and GLED2 to apply 8 mA of forward current to the green LEDs GLED1 and GLED2. In other words, by applying 3.15V of forward voltage to the green LEDs GLED1 and GLED2 to apply 8 mA of forward current thereto, each relative luminance of each green LED becomes 50 and a total relative luminance of the green LEDs GLED1 and GLED2 becomes 100.

Power consumption of these two LEDs GLED1 and GLED 2 are given as Equation 4.

$$P=V\times I=3.15\ V\times 8\ mA+3.15\ V\times 8\ mA=50.4\ mW \quad \text{[Equation 4]}$$

where the forward voltage of each of green LEDs GLED1 and GLED2 is 3.15V, and 8 mA of current flows therethrough, and therefore the power consumption of the green LEDs GLED1 and GLED2 is given as Equation 4.

In comparison between Equation 2 and Equation 4, the power consumption of using one green LED is calculated to be 68 mW, whereas the green LEDs coupled in parallel as described in the second exemplary embodiment of the present invention consumes the power of 50.4 mW which is less than using one green LED. In addition, a difference between the forward voltage respectively applied to the two green LEDs GLED1 and GLED2 (3.15V), the forward voltage applied to the red LED Vfr (3.8V), and the forward voltage applied to the blue LED Vfb (3.25V) is small enough to substantially prevent the voltage ripple, similar to the first exemplary embodiment of the present invention. In other words, the voltage levels of the forward voltages applied to the red, blue and green LEDs are almost the same or similar to each other.

As described in the second exemplary embodiment of the present invention, the power consumption can be reduced by using two green LEDs which have a characteristic of consuming much power, and coupling these two green LEDs in parallel. Here, two blue LEDs can also be coupled in parallel. However, such use of the blue LEDs in parallel reduces the power consumption less than when using the green LEDs in parallel, and tends to increase manufacturing cost due to an additional element. Accordingly, the green LEDs consuming much power and/or the blue LEDs can be coupled in parallel to efficiently reduce the power consumption, but such uses may result in increased manufacturing cost.

Figure 9:
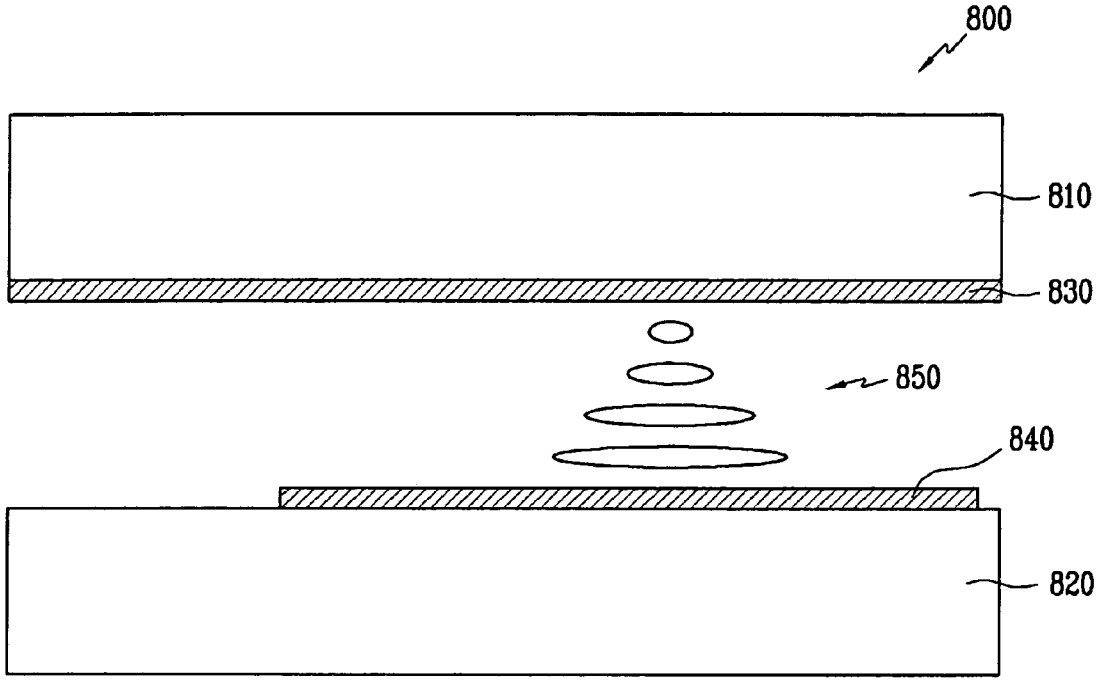
FIG. 9 illustrates a conceptual diagram of a pixel of a TFT-LCD.

FIG. 9 illustrates a conceptual diagram of a pixel 800 of a TFT-LCD. The pixel includes a liquid crystal 850 disposed between a first substrate 810 and a second substrate 820, a first electrode (common electrode) 830 arranged at the first substrate 810, and a second electrode (pixel electrode) 840 arranged at the second substrate 820. Exemplary embodiments of the present invention can be applied to the pixel of FIG. 9, as well as other suitable pixels. Further, the pixel 800 can represent any of the pixels 110 of FIG. 6. In addition, the first and second substrates 810, 820 and the liquid crystal 850 may be equivalently represented, for example, as the liquid crystal capacitor Cl in FIG. 1.

Accordingly, by way of coupling red LEDs in series, a forward voltage applied to each LEDs can be made similar or almost the same as each other, thereby substantially preventing a voltage ripple. In addition, power consumption can be reduced by coupling green LEDs, which consume the most power, in parallel and/or by coupling the blue LEDs in parallel.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A liquid crystal display device including a pixel formed by a liquid crystal disposed between a first substrate on which a first electrode is formed and a second substrate on which a second electrode is formed, and a light source controller having a first terminal and controlling red, green, and blue lights to be sequentially transmitted through the pixel, the liquid crystal display device comprising:

a first red light emitting diode (LED) having a first terminal and a second terminal, the first terminal being coupled to the first terminal of the light source controller;

a second red LED having a first terminal coupled to the second terminal of the first red LED;

a first green LED having a first terminal coupled to the first terminal of the light source controller; and a blue LED having a first terminal coupled to the first terminal of the light source controller, wherein a first voltage applied by the light source controller to emit the first and second red LEDs, a second voltage applied by the light source controller to emit the first green LED, and a third voltage applied by the light source controller to emit the blue LED have almost the same or similar voltage levels.

2. The liquid crystal display device according to claim 1, further comprising a second green LED having a first terminal coupled to the first terminal of the light source controller, and coupled to the first green LED in parallel.

3. The liquid crystal display device according to claim 2, wherein the first terminal of the light source controller outputs a voltage applied to at least one of the LEDs.

4. The liquid crystal display device according to claim 2, wherein the LEDs are formed in a single chip.

5. The liquid crystal display device according to claim 2, wherein a combined luminance of the first and second red LEDs, a combined luminance of the first and second green LEDs, and luminance of the blue LED substantially correspond to each other.

6. The liquid crystal display device according to claim 2, wherein the light source controller has second, third and fourth terminals, and the second red LED has a second terminal coupled to the second terminal of the light source controller, the first and second green LEDs have second terminals commonly coupled to the third terminal of the light source controller, and the blue LED has a second terminal coupled to the fourth terminal of the light source controller.

7. The liquid crystal display device according to claim 6, wherein the second terminal of the light source controller selects the first and second red LEDs, the third terminal of the light source controller selects the first and second green LEDs, and the fourth terminal of the light source controller selects the blue LED.

8. The liquid crystal display device according to claim 1, wherein the first terminal of the light source controller outputs a voltage applied to at least one of the LEDs.

9. The liquid crystal display device according to claim 1, wherein the LEDs are formed in a single chip.

10. The liquid crystal display device according to claim 1, wherein the first and second terminals of the LEDs are anodes and cathodes, respectively.

11. A liquid crystal display device including a pixel formed by a liquid crystal disposed between a first substrate on which a first electrode is formed and a second substrate on which a second electrode is formed, and a light source controller having first, second, third and fourth terminals, and controlling red, green, and blue lights to be sequentially transmitted through the pixel, the liquid crystal display device comprising:

a pair of red light emitting diodes (LEDs) coupled in series between the first terminal and the second terminal of the light source controller;

a green LED coupled between the first terminal and the third terminal of the light source controller; and a blue LED coupled between the first terminal and the fourth terminal of the light source controllers, wherein a first voltage applied by the light source controller to emit the pair of red LEDs, a second voltage applied by the light source controller to emit the green LED, and a third voltage applied by the light source controller to emit the blue LED have voltage levels that are proximate to each other.

12. The liquid crystal display device according to claim 11 further comprising another green LED coupled in parallel with the green LED between the first terminal and the third terminal of the light source controller.

13. The liquid crystal display device according to claim 12, wherein the first terminal of the light source controller outputs same or different voltages applied to the LEDs.

14. The liquid crystal display device according to claim 12, wherein the LEDs are formed in a single chip.

15. The liquid crystal display device according to claim 12, wherein a combined luminance of the pair of red LEDs, a combined luminance of the green LED and the another green LED, and luminance of the blue LED are substantially the same as each other.

16. The liquid crystal display device according to claim 11, wherein the first terminal of the light source controller outputs same or different voltages applied to the LEDs.

17. The liquid crystal display device according to claim 11, wherein the LEDs are formed in a single chip.

18. The liquid crystal display device according to claim 11, wherein a combined luminance of the pair of red LEDs, luminance of the green LED, and luminance of the blue LED are substantially the same as each other.

* * * * *

UNITED STATES PATENT AND TRADEMARK OFFICE

CERTIFICATE OF CORRECTION

PATENT NO. : 7,499,016 B2
APPLICATION NO. : 11/133857
DATED : March 3, 2009
INVENTOR(S) : Eun-Jung Oh et al.

It is certified that error appears in the above-identified patent and that said Letters Patent is hereby corrected as shown below:

In the Claims

Column 10, line 27, Claim 11 Delete “controllers” Insert -- controller --

Signed and Sealed this
Tenth Day of May, 2011

David J. Kappos

David J. Kappos
*Director of the United States Patent and Trademark Office*